US006204452B1

(12) United States Patent
Valadez et al.

(10) Patent No.: US 6,204,452 B1
(45) Date of Patent: Mar. 20, 2001

(54) FLEXIBLE AUTOMOTIVE ELECTRICAL CONDUCTOR OF HIGH MECHANICAL STRENGTH, AND PROCESS FOR THE MANUFACTURE THEREOF

(75) Inventors: Armando Rodriguez Valadez; Juan De Dios Concha Malo; Belisario Sanchez Vazquez; Mario Sanchez Mello, all of Querétaro Qro (MX)

(73) Assignee: Servicious Condumex S.A. de C.V., Queretaro (MX)

( * ) Notice: Subject to any disclaimer, the term of this patent is extended or adjusted under 35 U.S.C. 154(b) by 0 days.

(21) Appl. No.: 09/168,902

(22) Filed: Oct. 9, 1998

(30) Foreign Application Priority Data

May 15, 1998 (MX) ..... 983858

(51) Int. Cl.[7] ..... H01B 5/00
(52) U.S. Cl. ..... 174/126.1; 174/126.2
(58) Field of Search ..... 174/110 R, 113 R, 174/36, 125.1, 126.2

(56) References Cited

U.S. PATENT DOCUMENTS

| | | | | |
|---|---|---|---|---|
| 251,114 | * | 12/1881 | Hallidie . | |
| 1,629,168 | * | 5/1927 | Massingham . | |
| 3,083,817 | * | 4/1963 | Campbell | 205/2 |
| 3,131,469 | * | 5/1964 | Glaze | 29/470.5 |
| 3,795,760 | * | 3/1974 | Raw et al. | 174/128 |
| 3,819,399 | * | 6/1974 | Campbell et al. | 117/49 |
| 3,831,370 | * | 8/1974 | Gilmore | 57/145 |
| 4,623,218 | * | 11/1986 | Laurette et al. | 350/96.2 |
| 4,651,513 | * | 3/1987 | Dambre | 57/217 |
| 5,133,121 | * | 7/1992 | Birbeck et al. | 29/872 |
| 5,170,015 | * | 12/1992 | Kudo et al. | 174/128.1 |
| 5,679,232 | * | 10/1997 | Fedor et al. | 205/77 |

* cited by examiner

*Primary Examiner*—Kristine Kincaid
*Assistant Examiner*—William H Mayo, III
(74) *Attorney, Agent, or Firm*—Carmen Pili Curtis

(57) ABSTRACT

This invention relates to the manufacturing of a seven-wire symmetrical hybrid conductor (one hard copper alloy wire in the center—six hard ETP copper peripheral wires) in 24 and 26 AWG gauges that fulfills the SAE J-1678 and Ford specifications with regard to electrical resistance and breaking load, having an outside diameter proper for smooth thin wall insulation.

15 Claims, 2 Drawing Sheets

FLEXIBLE AUTOMOTIVE ELECTRICAL CONDUCTOR OF HIGH MECHANICAL STRENGTH, AND PROCESS FOR THE MANUFACTURE THEREOF

BACKGROUND OF THE INVENTION

Among the technological developments regarding the automotive industry, there are processes focused towards the manufacturing of low tension primary cable for automotive vehicle use.

The requirements of the automotive industry, world-wide, for materials to be used in the short term (year 2000), are based on the following aspects:

Trends in the automotive market at world level.

Alternatives to fulfill the requirements of the automotive industry.

Present and future norms and specifications of the automotive industry.

Commercially available materials that, according to their properties, can fulfill the automotive cable requirements.

The trends in the automotive industry have been focused towards weight reduction in order to reach a lower demand for fuel. On the other hand, the demand for vehicles that offer better safety, luxury and comfort, and the consequent need for cables for the various additional circuits, has increased rapidly and will continue to increase in the coming years.

Conductor diameter reduction, while maintaining the same mechanical characteristics as the conductors presently used in the automotive harnessed, is the alternative chosen by the designers and it will continue to be the main trend during the coming years. This makes it necessary to resort to the conductor materials more mechanically resistant than copper, keeping an adequate balance between mechanical resistance and electrical conductivity in order to meet the specifications.

Presently there are two specification proposals with regard to an automotive cable that covers the previously described characteristics, said two proposals are as follows:

Norm SAE J-1678 "Low Tension, Ultra Thin Wall Primary Cable"

FORD Engineering Specification—"Cable, Primary Low Tension 0.25 mm and 0.15 mm Wall"

Said specifications do not describe the material with which conductors have to be manufactured, but establish a minimum breaking load as well as a maximum electrical resistance; in this case, the present invention encompasses the 24 and 26 AWG conductors, which present as design condition, seven-wire strand symmetrical formation.

Presently the conductors used for gauges below 22 AWG are manufactured from 100% copper alloys, which must have a mechanical and electrical resistance that meets the above specification.

SUMMARY OF THE INVENTION

It is thus an object of the present invention to produce:

Hybrid conductors with a seven-wire strand symmetrical construction, i.e., use a high strength wire in the center and 6 hard ETP copper wires in the periphery. With regard to 24 AWG gauge conductor, the 7 wires are 32 AWG gauge; with regard to the 26 AWG gauge conductor, the center wire is 33 AWG gauge, while the 6 peripheral wires are 34 AWG gauge.

BRIEF DESCRIPTION OF THE DRAWING

The invention will be better understood and its objects and advantages will become more apparent by reference to the following drawings, in which.

DETAILED DESCRIPTION OF THE DRAWINGS

Figure 1:
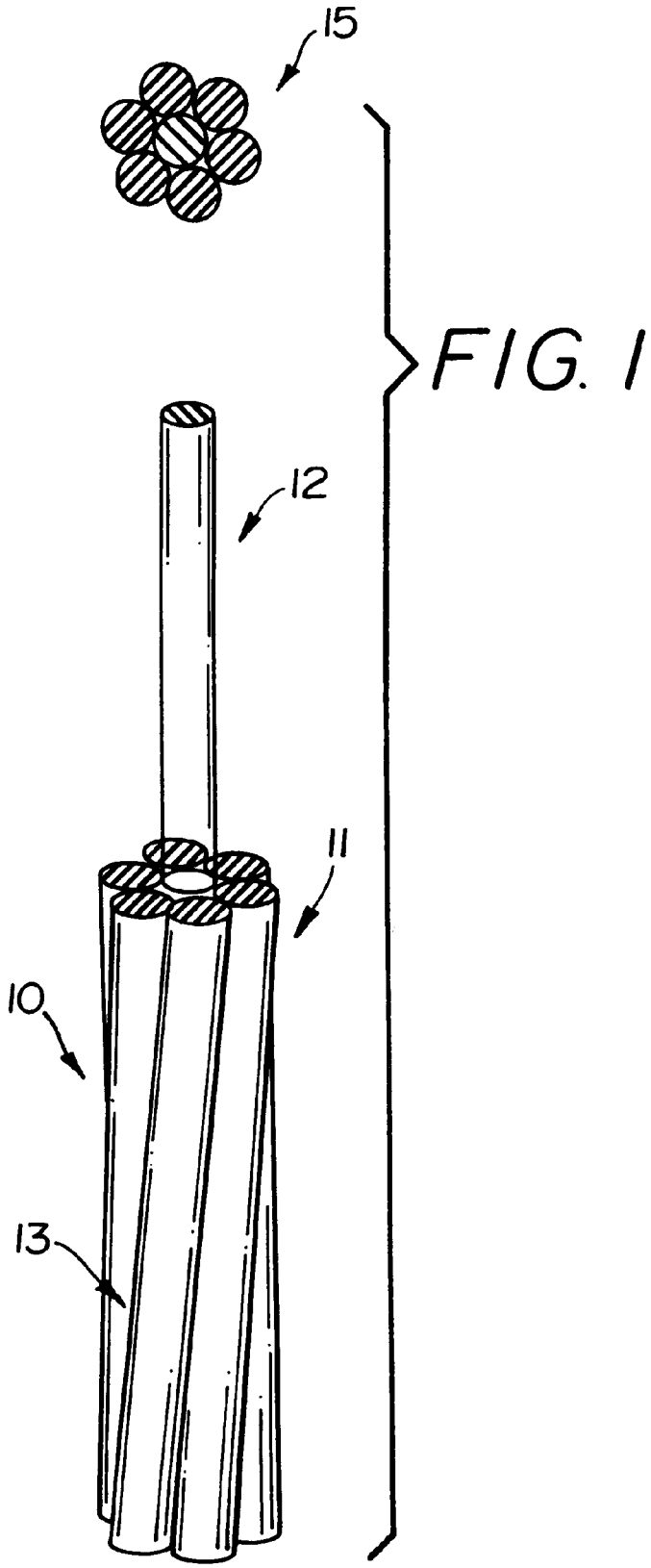
FIG. 1 is a cross-sectional view and longitudinal view of the 24 AWG gauge conductor and FIG. 2 is also a cross-sectional view and a longitudinal view of a conductor, but 26 AWG gauge this time. Its main characteristic is that it is a hybrid conductor, i.e. the high strength central wire must have a mechanical resistance higher than the mechanical resistance of hard condition electrolytic copper, while the peripheral wires must be made of electrolytic copper in hard condition.
Figure 2:
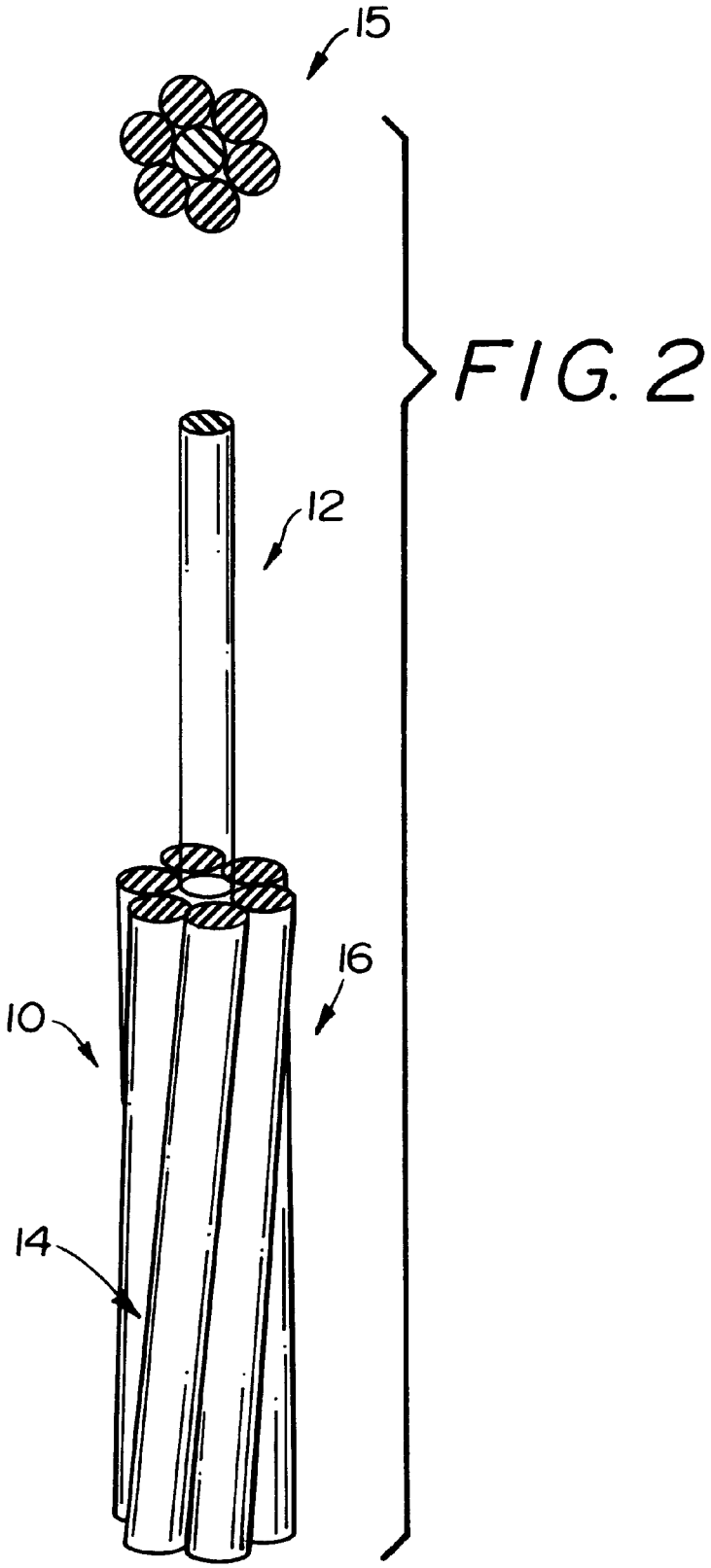

The automotive electric conductor 10 is a symmetrical hybrid conductor 15 made up of a bundle of seven wires 11, both in FIG. 1 and in FIG. 2. In the case of 24 AWG gauge conductor the seven wires are 32 AWG gauge, while in the case of 26 AWG gauge conductor, the central wire 12 is 33 AWG gauge, and the 6 peripheral wires 16 are 34 AWG gauge. For both conductors the central wire 12 is made of copper alloy in hard condition and must have a mechanical resistance above 90 kg/mm$^2$ with a minimum elongation of 1%, while the peripheral wires in both conductors are made of hard ETP copper and must have a mechanical resistance above 50 kg/mm$^2$ with a minimum elongation of 1%.

The high strength materials are copper clad steel with 40% conductivity, C23000 brass and C27000 brass.

The lay is the straight length at which the same wire of the conductor appears at a similar point after having helically traveled along the conductor. This variable must be such that the central wire is always located at the center of the conductor. Thus, a 24 AWG gauge conductor must have a lay 13 shorter than 15 mm and a 26 AWG gauge conductor must have a lay 14 shorter than 10 mm.

The following Table 1 shows the characteristic features of the conductor such as physical, mechanical and electrical characteristics which must be fulfilled by each one of the conductors:

TABLE I

| CONDUCTOR AREA (mm$^2$) ISO | CONDUCTOR GAUGE (AWG) | CONDUCTOR DIAMETER (mm) Specified | MAXIMUM RESISTANCE (mΩ/m) Specified | MINIMUM LOAD (Kg.) Specified |
|---|---|---|---|---|
| 0.22 | 24 | 0.70 | 84.9/96.94 | 9 |
| 0.13 | 26 | 0.50 | 136/189 | 9 |

Hereinbelow the manufacturing process is described for said flexible type electric conductor with high mechanical resistance based on high strength materials with some copper content, which is useful for automotive service.

The process includes the following stages: Breakdown drawing; final drawing (copper and high strength materials); thereafter the bunching, or stranding of high strength 24

AWG gauge conductor with 32 AWG gauge wire, or 26 AWG gauge conductor with 33 AWG gauge at the center and 6 wires 34 AWG gauge at the peripheral.

Hereinafter the abovementioned stages are described;

ETP Copper Breakdown Drawing

The starting material is 8 mm diameter annealed ETP copper wire which is drawn in order to obtain an annealed 13 AWG gauge wire.

ETP Copper Final Drawing

It is obtained starting from an annealed 13 AWG gauge wire which is drawn in one unique step in unifilar (single wire) or multiline machine to obtain a 32 AWG gauge wire in the case of 24 AWG gauge conductor and 34 AWG gauge wire in the case of 26 AWG gauge conductor, both wires are in hard condition.

High Strength Material Final Withdrawing

The materials can be purchased in form of annealed 20 AWG gauge wire and can be withdrawn in only one step in order to obtain 32 AWG gauge wire, in the case of 24 AWG gauge conductor, and 33 AWG gauge wire in the case of 26 AWG gauge conductor, both in hard condition.

Bunching or Stranding of 24 AWG Gauge Conductor

In this stage, a bunching machine is used in which a symmetrical construction of 7 wires is carried out. The central wire is high strength 32 AWG gauge wire and the 6 peripheral wires are made of 32 AWG gauge hard ETP copper wire. The lay of the conductors must be below 15 mm in order to ensure the centering of the copper alloy wire.

Bunching or of 26 AWG Gauge Conductor

At this stage, a bunching or stranding machine is used in which a symmetrical construction of 7 wires is carried out. The central wire is high strength 33 AWG gauge wire and the 6 peripheral wires are made of 34 AWG gauge hard ETP copper wire. The lay of the conductors must be below 10 mm in order to ensure the centering of the copper alloy wire.

The advantages offered by the hybrid conductor are:

It is a conductor with hard high strength wire at the center and hard ETP copper at the periphery and it is not made of 100% copper alloy.

It is a conductor which is smaller and lighter than the present conductors but with a higher breaking load, as well as an electrical resistance within the automotive specifications for copper alloys.

Upon bunching or stranding it, this cable must be manufactured taking care that the tension is controlled in such a way that the alloy wire is always in the center of the conductor in order to fulfill the maximum electrical resistance requirements specified and to ensure an excellent surface smoothness and concentricity.

In Table I, the physical, mechanical and electrical properties that must be fulfilled by each one of the conductors are presented.

In Table II, the chemical composition of the wires used in the manufacturing of hybrid conductors is described.

TABLE II

| MATERIAL | Cu(%) | Zn(%) | O(%) | Other(%) |
|---|---|---|---|---|
| ETP Cu | 99.9 | | 0.04 | 0.01 |
| C23000 brass | 85 | 15 | | |
| C27000 brass | 70 | 30 | | |

The copper clad steel (CCS) is made up of 1010 carbon steel covered with an ETP copper layer with 40% conductivity.

It is thus believed that the operation and construction of the present invention will be apparent from the foregoing description. The full scope of the present invention is defined in the following claims.

What is claimed is:

1. A high mechanical strength, flexible automotive electrical conductor comprising:

a) a central wire comprising a high strength material in hard condition; and b) a plurality of wires helically laid about the central wire, wherein the central wire is copper alloy comprising 65 to 90% copper and 10 to 35% zinc.

2. The conductor according to claim 1 wherein the central wire has a mechanical resistance of above 90 Kg/mm$^2$ and a minimum elongation of 1%.

3. The conductor according to claim 1 wherein the copper alloy comprises 70 to 90% copper and 10 to 30% zinc.

4. The conductor according to claim 1 wherein the wires helically laid about the central wire are made of hard ETP copper having a mechanical resistance above 50 Kg/mm$^2$ and a 1% minimum elongation.

5. The conductor according to claim 4 wherein the central wire is a high strength 32 AWG gauge wire.

6. The conductor according to claim 5 wherein the wires helically laid about the central wire comprise six wires and are made of 32 AWG gauge hard ETP copper wire to form a 24 AWG gauge wire.

7. The conductor according to claim 6 wherein the lay of the wires is shorter than 15 mm.

8. The conductor according to claim 4 wherein the central wire is a high strength 33 AWG gauge wire.

9. The conductor according to claim 8 wherein the wires helically laid about the central wire comprise six wires and are made of 34 AWG gauge hard ETP copper wire to form a 26 AWG gauge wire.

10. The conductor according to claim 9 wherein the lay of the wires is shorter than 10 mm.

11. A process for the manufacture of high mechanical strength, flexible automotive electrical conductor according to claim 8 comprising the following steps:

(a) breakdown drawing of said central wire comprising said high strength material in hard condition to obtain an annealed material;

(b) final drawing of the annealed material; and (c) bunching the central wire with said plurality of wires to form said conductor.

12. The process according to claim 11 wherein the central wire has a mechanical resistance of above 90 Kg/mm$^2$ and a minimum elongation of 1%.

13. The process according to claim 12 wherein the central wire is selected from the group consisting of a high strength 32 AWG gauge wire and a high strength 33 AWG gauge wire.

14. The process according to claim 14 wherein the wires helically laid about the central wire comprise six wires and are made of 32 AWG gauge hard ETP copper wire to form a 24 AWG gauge wire when the central wire is said 32 AWG gauge wire.

15. The process according to claim 13 wherein the wires helically laid about the central wire comprise six wires and are made of 34 AWG gauge hard ETP copper wire to form a 26 AWG gauge wire when the central wire is said 33 AWG gauge wire.

* * * * *